US010605149B2

(12) United States Patent
Benjamin et al.

(10) Patent No.: US 10,605,149 B2
(45) Date of Patent: Mar. 31, 2020

(54) WASTE HEAT RECOVERY INTEGRATED COOLING MODULE

(71) Applicant: CUMMINS INC., Columbus, IN (US)

(72) Inventors: Jithin Benjamin, Columbus, IN (US); Timothy C. Ernst, Columbus, IN (US); James A. Zigan, Versailles, IN (US); Kevin C. Augustin, Sr., Greenwood, IN (US); David E. Koeberlein, Columbus, IN (US); Nimish Bagayatkar, Carmel, IN (US)

(73) Assignee: Cummins Inc., Columbus, IN (US)

( * ) Notice: Subject to any disclaimer, the term of this patent is extended or adjusted under 35 U.S.C. 154(b) by 126 days.

(21) Appl. No.: 15/521,962

(22) PCT Filed: Oct. 27, 2015

(86) PCT No.: PCT/US2015/057668

§ 371 (c)(1),
(2) Date: Apr. 26, 2017

(87) PCT Pub. No.: WO2016/069658

PCT Pub. Date: May 6, 2016

(65) Prior Publication Data

US 2017/0335745 A1 Nov. 23, 2017

Related U.S. Application Data

(60) Provisional application No. 62/068,889, filed on Oct. 27, 2014, provisional application No. 62/069,074, filed on Oct. 27, 2014.

(51) Int. Cl.
*F01P 3/18* (2006.01)
*F02G 5/04* (2006.01)
(Continued)

(52) U.S. Cl.
CPC ..... *F01P 3/18* (2013.01); *F01K 9/003* (2013.01); *F01K 23/065* (2013.01); *F01P 3/20* (2013.01);
(Continued)

(58) Field of Classification Search
CPC ..... F01P 3/18; F01P 3/20; F01P 5/12; F01P 2005/105; F01P 2060/14; F01K 9/003; F01K 23/065; F02G 5/04
See application file for complete search history.

(56) References Cited

U.S. PATENT DOCUMENTS

| | | | |
|---|---|---|---|
| 2,191,289 | A | 2/1940 | Price |
| 3,434,532 | A | 3/1969 | Henriksson |

(Continued)

FOREIGN PATENT DOCUMENTS

| | | |
|---|---|---|
| CN | 102066697 A | 5/2011 |
| JP | 2010190186 | 9/2010 |
| JP | 5529070 | 7/2013 |

OTHER PUBLICATIONS

"Cummins Peterbilt SuperTruck gets Modine waste heat recovery heat exchangers", Mechanical News and Products, vol. 10, Issue 9 (DesignFax), Mar. 4, 2014.

(Continued)

*Primary Examiner* — Marc E Norman
(74) *Attorney, Agent, or Firm* — Faegre Drinker Biddle & Reath LLP

(57) ABSTRACT

Integrated cooling systems including a frame configured for mounting to a vehicle chassis in a path of ram air entering an engine compartment of a vehicle, a radiator connected to the frame in the ram air path, a waste heat recovery (WHR) condenser, a recouperator connected to the frame above a ram air path and coupled to the WHR condenser, and a coolant boiler connected to the frame below the ram air path
(Continued)

and coupled to the radiator and recouperator are disclosed. Cooling systems configured for use in a WHR system, including an inlet header fixedly disposed on a first end of a condenser, the inlet header fluidly coupled to a heat exchanger to receive the working fluid, and a receiver fixedly disposed on a second end of the condenser opposite the first end, the receiver configured to receive the working fluid from the condenser are also disclosed.

19 Claims, 12 Drawing Sheets

(51) Int. Cl.

| | |
|---|---|
| ***F01K 9/00*** | (2006.01) |
| ***F01K 23/06*** | (2006.01) |
| ***F01P 3/20*** | (2006.01) |
| ***F01P 5/12*** | (2006.01) |
| *F01P 5/10* | (2006.01) |

(52) U.S. Cl.
CPC ..... *F01P 5/12* (2013.01); *F02G 5/04* (2013.01); *F01P 2005/105* (2013.01); *F01P 2005/125* (2013.01); *F01P 2060/14* (2013.01)

(56) References Cited

U.S. PATENT DOCUMENTS

| | | | | |
|---|---|---|---|---|
| 4,145,888 | A | 3/1979 | Roberts | |
| 5,031,725 | A | 7/1991 | Millar | |
| 5,045,711 | A | 9/1991 | Swearingen | |
| 5,095,706 | A | 3/1992 | Saito et al. | |
| 6,029,345 | A * | 2/2000 | Christensen | B60K 11/04 165/140 |
| 6,857,287 | B1 * | 2/2005 | Alsenz | F25B 1/00 62/45.1 |
| 7,243,710 | B2 | 7/2007 | Shinhama | |
| 7,845,392 | B2 | 12/2010 | Morita | |
| 8,556,577 | B2 | 10/2013 | Bell | |
| 8,628,025 | B2 | 1/2014 | Bucknell | |
| 8,635,870 | B2 | 1/2014 | Kasuya et al. | |
| 8,707,914 | B2 | 4/2014 | Barnes | |
| 8,769,977 | B2 | 7/2014 | Renner | |
| 2005/0044884 | A1 * | 3/2005 | Telesz | F25B 39/04 62/509 |
| 2006/0185631 | A1 | 8/2006 | Fitzgerald | |
| 2006/0196464 | A1 | 9/2006 | Conners | |
| 2008/0110171 | A1 | 5/2008 | Schmeltz | |
| 2010/0034684 | A1 | 2/2010 | Ast | |
| 2010/0043432 | A1 | 2/2010 | Filippone | |
| 2012/0023946 | A1 * | 2/2012 | Ernst | F01K 9/04 60/660 |
| 2013/0180242 | A1 | 7/2013 | Lancaster | |
| 2013/0186088 | A1 | 7/2013 | Glover | |
| 2014/0007575 | A1 | 1/2014 | Ernst et al. | |
| 2014/0144136 | A1 | 5/2014 | Versteyhe | |
| 2014/0165562 | A1 | 6/2014 | Nagai | |
| 2014/0260250 | A1 | 9/2014 | Oxner | |
| 2014/0345274 | A1 | 11/2014 | Ernst | |
| 2014/0352301 | A1 | 12/2014 | Mueller | |
| 2017/0335745 | A1 | 11/2017 | Benjamin et al. | |
| 2018/0135503 | A1 * | 5/2018 | Ernst | F01K 23/065 |

OTHER PUBLICATIONS

"The U.S. Supertruck Program, Expediting the Development of Advanced Heavy-Duty Vehicle Efficiency Technologies", The International Counsel on Clean Transportation (Oscar Delgado, Nic Lutsey), Jun. 2014.

"The Peterbilt-Cummins Super Truck, Paart 2: More Secrets Revealed" (Jim Park), Jul. 2014.

International Search Report issued by the International Searching Authority, dated Mar. 18, 2016, for related International Patent Application No. PCT/US2015/057668; 4 pages.

Written Opinion of the International Searching Authority, dated Mar. 18, 2016, for related International Patent Application No. PCT/US2015/057668; 5 pages.

International Preliminary Report on Patentability, issued by the International Searching Authority, dated Feb. 20, 2017; 11 pages.

* cited by examiner

WASTE HEAT RECOVERY INTEGRATED COOLING MODULE

CROSS-REFERENCE TO RELATED APPLICATION

This application is a National Stage of International Application No. PCT/US2015/057668, filed Oct. 27, 2015, which claims priority to U.S. Provisional Application Ser. No. 62/069,074, filed on Oct. 27, 2014 and U.S. Provisional Application Ser. No. 62/068,889, filed on Oct. 27, 2014, the entire disclosures of which are hereby expressly incorporated herein by reference.

FIELD OF THE DISCLOSURE

The present disclosure generally relates to waste heat recovery ("WHR") systems for use with internal combustion (IC) engines, and also to methods and systems for integrating WHR heat exchangers into an integrated cooling system or module to improve overall cost effectiveness and reduce plumbing requirements.

BACKGROUND OF THE DISCLOSURE

Internal combustion engines used to power vehicles generate heat as a result of inherent inefficiencies of converting fuel into energy. As heat represents energy potential, recovery of the heat permits its conversion into mechanical and/or electrical power that would otherwise be lost through cooling and heat rejection. This recovery may enhance the fuel efficiency of the vehicle and reduce harmful emissions. Thus, recovering waste heat produced during the operation of internal combustion (IC) engines (e.g., diesel engines) provides one way to meet legislated and competitive fuel efficiency and emission requirements for IC engines.

Heat is generally recovered from sources of high temperature, for example, the exhaust gas produce by the IC engine, or compressed intake gas. Such high grade WHR systems include components which are configured to extract the heat from the high temperature source. These components can include exhaust gas recirculation (EGR) boilers, pre-charge air coolers (pre-CAC), exhaust system heat exchangers, or other components configured to extract heat from the high grade source of heat. The components included in conventional high grade WHR systems are disposed as separate components fluidly coupled together, and can be prone to leak paths. This can lead to reduced cost savings, poor performance, and reduced transient capability.

WHR systems exist for capturing heat energy generated by internal combustion engines that would be otherwise lost through cooling and/or exhaust. Such systems typically include many components mounted at various locations on the engine. Plumbing is used to transfer mass between the heat exchangers at the various locations in such systems. The distributed nature of the components and interconnected plumbing results in inefficient usage of the limited space in the engine compartment, and leads to heat losses through the plumbing. Conventional systems also increase the complexity of integrating a WHR system onto a base engine.

Accordingly, it would be desirable to provide an integrated arrangement of the heat exchangers of a WHR system such that mass transfer between the heat exchangers is more efficient and reduces the on-engine space claim of the system.

SUMMARY

According to some embodiments, an integrated cooling system for a waste heat recovery ("WHR") system comprising a frame configured for mounting to a vehicle chassis in a path of ram air entering an engine compartment of a vehicle, a radiator connected to the frame in the ram air path, a WHR condenser connected to the frame, a recouperator connected to the frame above the ram air path and coupled to the WHR condenser, and a coolant boiler connected to the frame below the ram air path and coupled to the radiator and recouperator is provided.

In additional embodiments, a cooling system for use in a WHR system is also provided that may comprise a condenser configured to condense a working fluid. An inlet header is disposed on a first end of the condenser. The inlet header is fluidically coupled to a heat exchanger to receive the working fluid from the expander or heat exchanger and communicate the working fluid to the condenser.

In various embodiments, the receiver may be fixedly disposed on a second end of the condenser opposite the first end and is configured to receive the working fluid from the condenser.

According to additional embodiments, a liftpump may be disposed in the receiver and configured to communicate a working fluid to the primary pump in the system (or feed-pump). A level sensor may be disposed in the receiver and configured to measure a level of the working fluid in the receiver. In some embodiments, the condenser, the inlet header, the receiver, the liftpump and the level sensor may be fixedly coupled to each other in a single unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
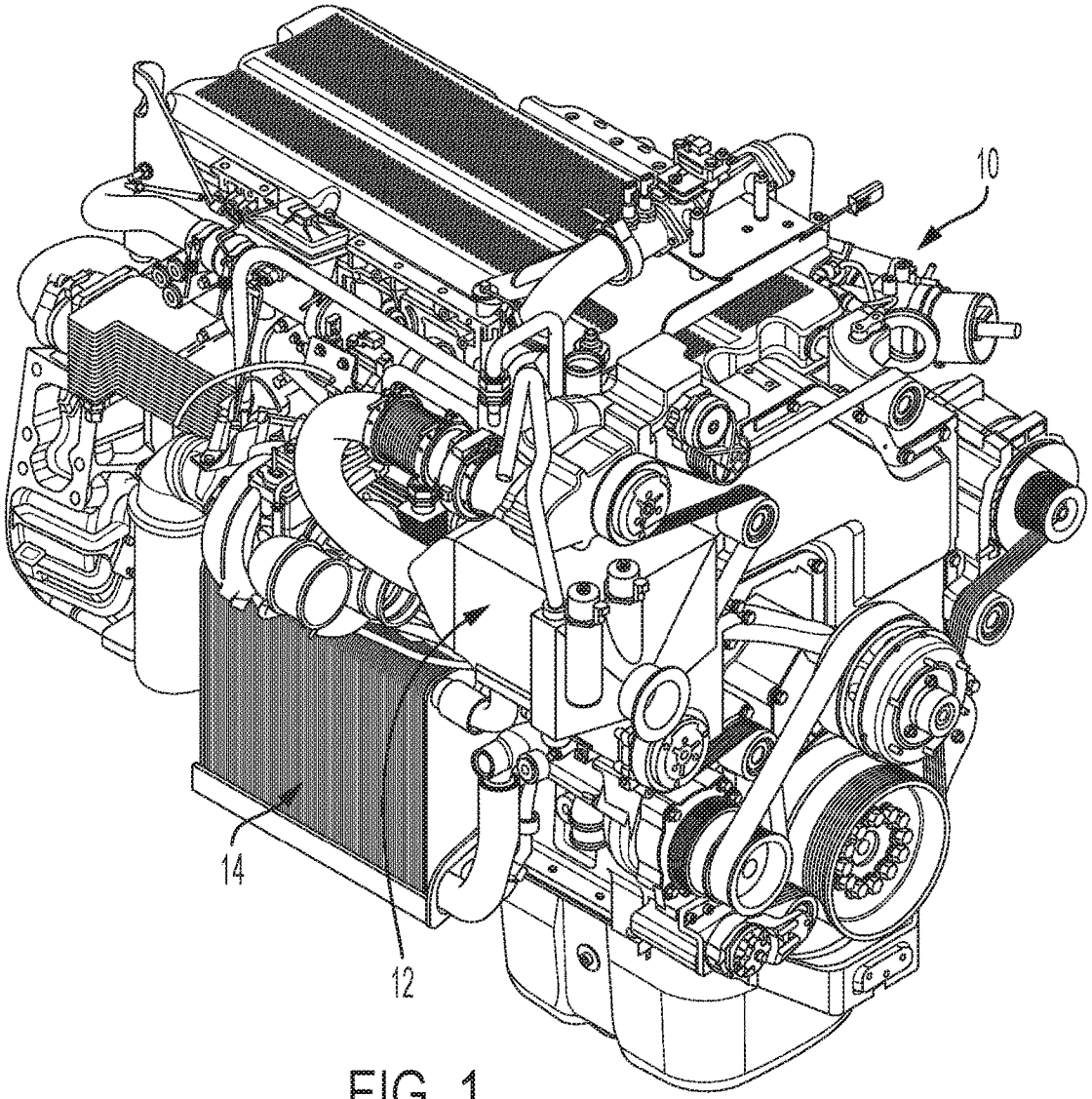
FIG. 1 PRIOR ART
FIG. 1 is a perspective view of a conventional internal combustion engine equipped with heat exchangers for a WHR system.

FIG. 1 depicts components of a conventional WHR system mounted to an engine 10. As shown, a recouperator 12 is mounted to engine 10 and is connected to coolant boiler 14 which is also mounted to engine 10. In this prior art configuration, recouperator 12 and coolant boiler 14 are connected through plumbing (not shown) to other components of the system such as a radiator and WHR condenser.

Figure 2:
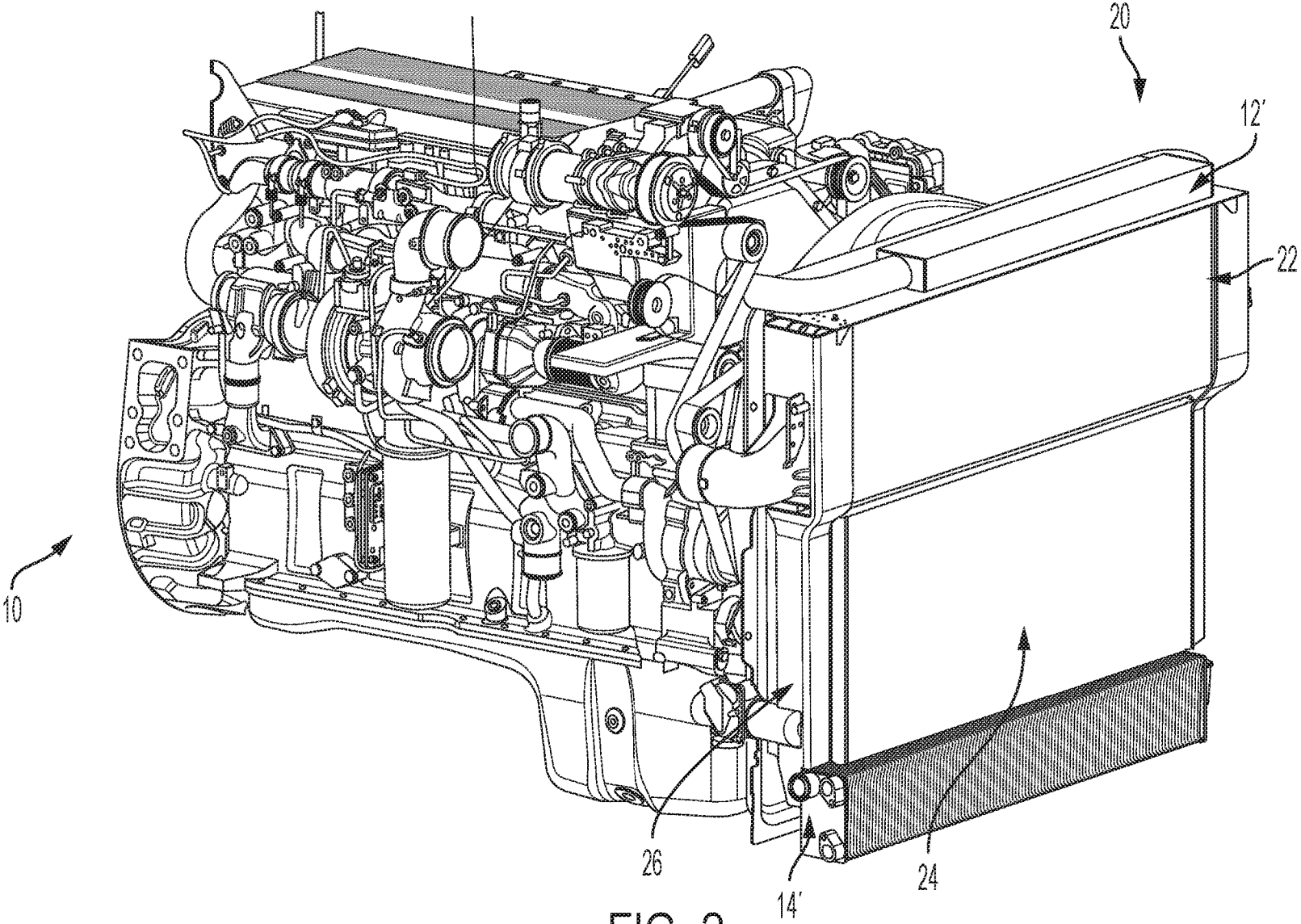
FIG. 2 is a perspective view of an off-engine integrated cooling system according to various embodiments of present disclosure.

Referring now to FIG. 2, an integrated cooling system 20 according to various embodiments of the present disclosure is shown connected to engine 10. As is further described below, system 20 is mounted "off-engine" at the front of the vehicle. System 20 generally includes a recouperator 12', a charge air cooler ("CAC") 22, an AC condenser 24, a radiator 26, a coolant boiler 14', and a WHR condenser 28 (shown in FIG. 4B), all connected to and supported by a frame 66 (shown in FIG. 8).

Figure 3:
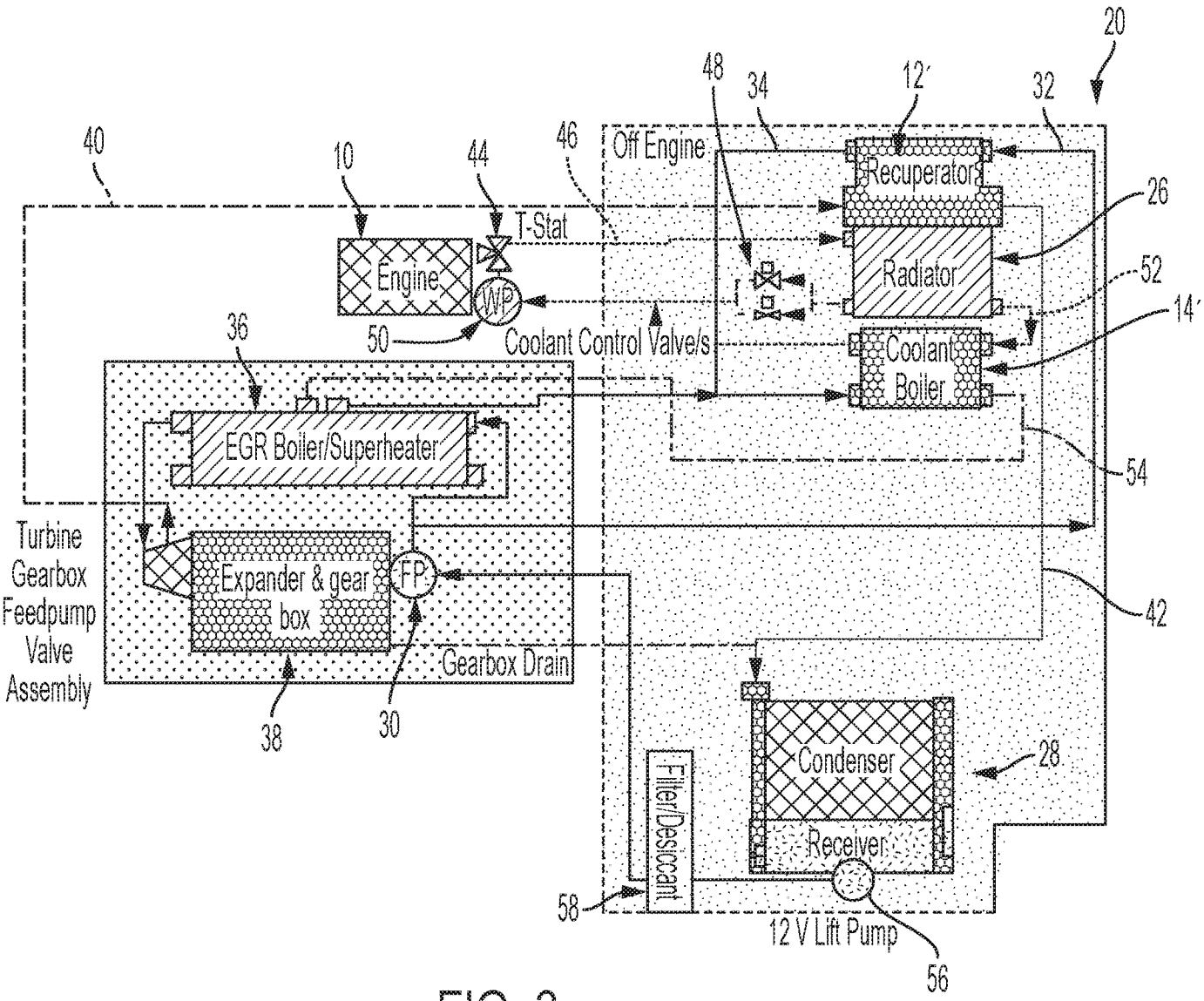
FIG. 3 is a schematic diagram of a WHR system including the integrated cooling system of FIG. 2.
Figure 4A:
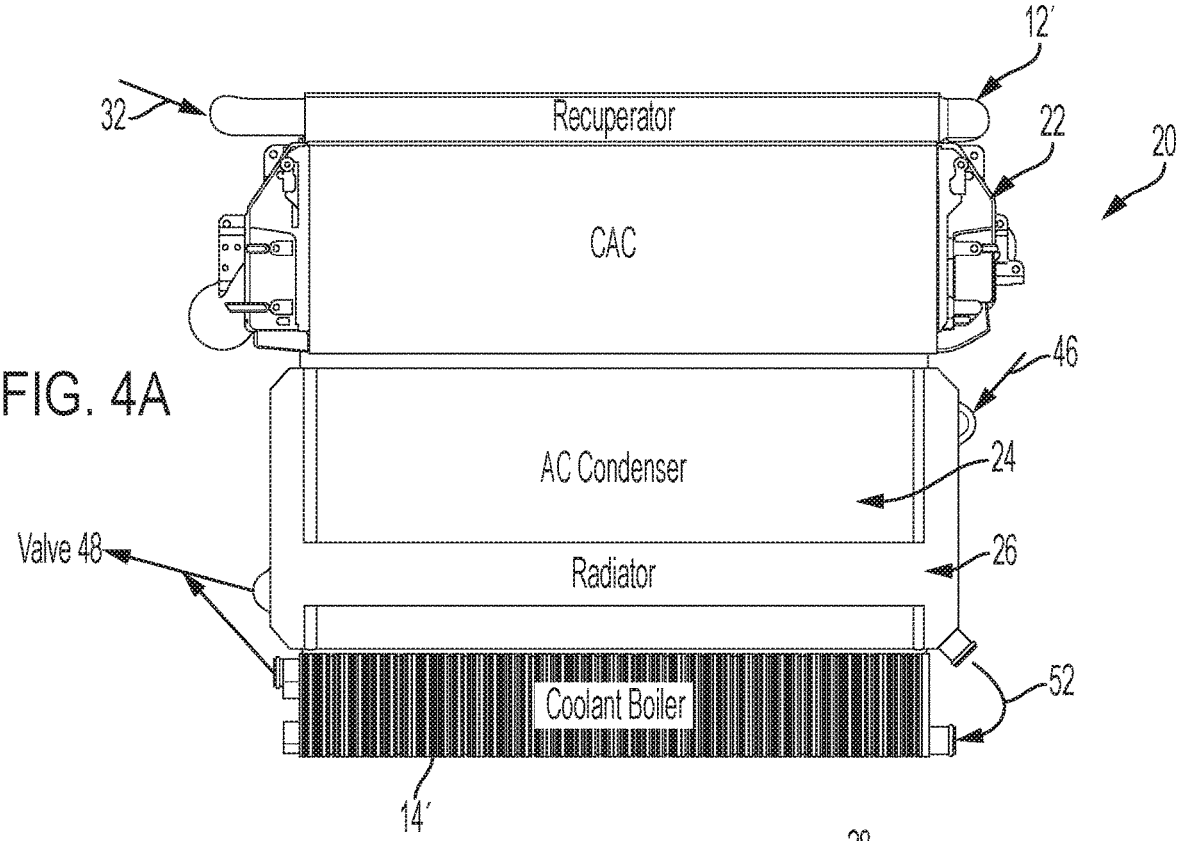
FIG. 4A is a front plan view of the integrated cooling system of FIG. 2.
Figure 4B:
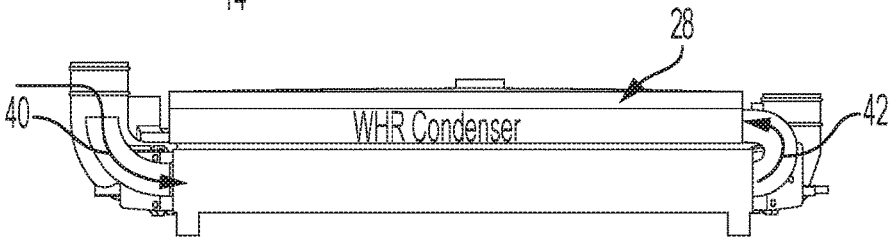
FIG. 4B is a top plan view of the integrated cooling system of FIG. 2.

As best shown in FIGS. 3 and 4A-B, recouperator 12' receives cold refrigerant from a feed pump 30 through line 32. Warmed refrigerant is provided from recouperator 12' to coolant boiler 14' through line 34 which also extends from engine gas recirculation ("EGR") boiler/superheater 36. Additionally, recouperator 12' receives heated vapor from expander and gear box 38 through line 40. As further described below, an output of recouperator 12' is routed to an input of WHR condenser 28 through line 42.

According to principles known in the art and with the benefit of this disclosure, radiator 26 receives coolant from thermostat 44 through line 46 when the coolant is sufficiently heated by operation of engine 10. Valve 48, which is connected to water pump 50, controls the amount of coolant provided to radiator 26 and coolant boiler 14' based on engine load. Control provided by valve 48 to coolant boiler 14' aids in control of the top tank temperatures to specified values under various engine loads. More specifically, under full load conditions, radiator 26 gets full flow to ensure that the top tank temperature is maintained. An outlet of radiator 26 is connected to coolant boiler 14' through line 52. An output of coolant boiler 14' is connected to EGR boiler/superheater 36 through line 54. Finally, an outlet of WHR condenser 28 (through lift pump 56 and filter 58) is routed to feed pump 30.

As should be apparent from the foregoing, recouperator 12' and coolant boiler 14' function as heat exchangers in the WHR system. Recouperator 12' receives hot refrigerant from expander 38 (FIG. 3) and transfers heat to cold refrigerant from feed pump 30. Coolant boiler 14' transfers heat from engine coolant to the refrigerant.

Figure 5:
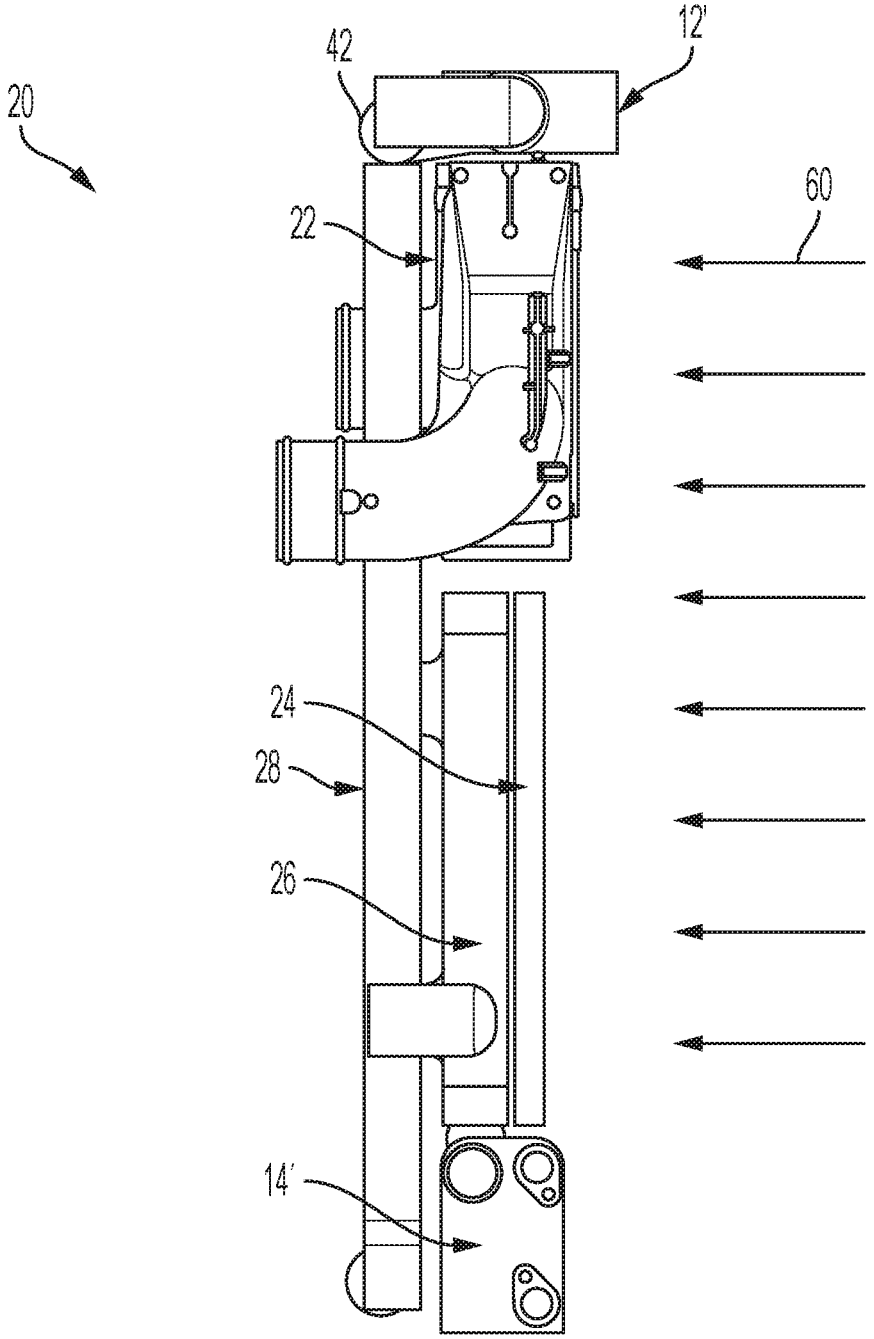
FIG. 5 is a side plan view of the integrated cooling system of FIG. 2.

As best shown in FIGS. 4B and 5, system 20 provides a compact, stacked arrangement of components with recouperator 12' at the top and coolant boiler 14 at the bottom. WHR condenser 28 is in its conventional position behind (relative to the direction of ram air 60) CAC 22 and radiator 26. In other embodiments, WHR condenser 28 may be located in front of CAC 22 and radiator 26. Because recouperator 12' is disposed at the top of system 20 and coolant boiler 14' is disposed at the bottom, there is a very short connection through line 42 from recouperator 12' to the upper inlet manifold of WHR condenser 28 and a very short connection through line 52 from radiator 26 to coolant boiler 14'. Also, the uppermost position of recouperator 12' helps in draining refrigerant, which may change phase during the heat transfer process, into WHR condenser 28. If not properly drained, such refrigerant may reduce the efficiency of recouperator 12'. Additionally, the lowermost position of coolant boiler 14' permits efficient mass transfer of coolant from radiator 26 back to pump 50 with minimal plumbing and effective control using valve 48.

It should be understood that while WHR condenser 28 is described herein as being a vertical condenser, a horizontal condenser could also be used consistent with the teachings of the present disclosure. Moreover, it should be understood that while recouperator 12' is described herein as being disposed at the uppermost position of system 20, recouperator 12' may be disposed in a lower position. For example, recouperator 12' could be located as low as the upper ⅔s (as viewed in FIG. 4A) of WHR condenser 28 where it could still vent out into WHR condenser 28.

Figure 6:
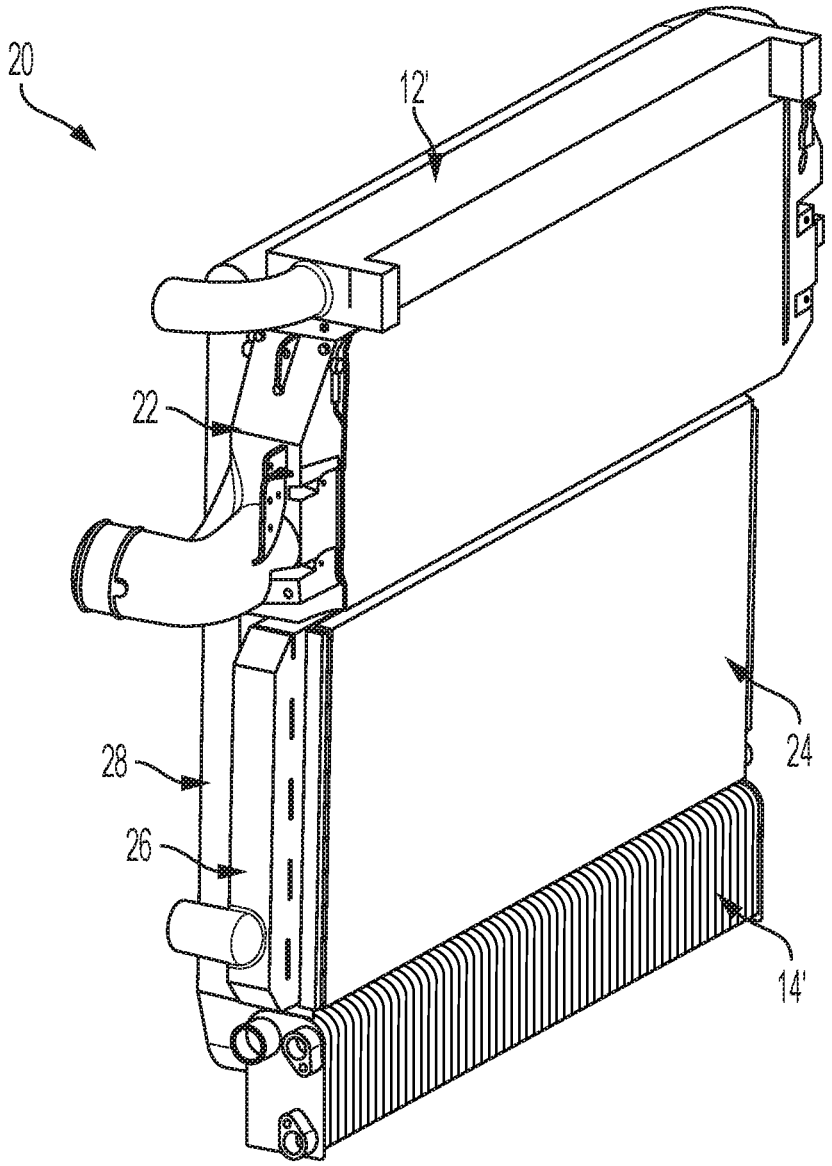
FIG. 6 is a perspective view of the integrated cooling system of FIG. 2.
Figure 7:
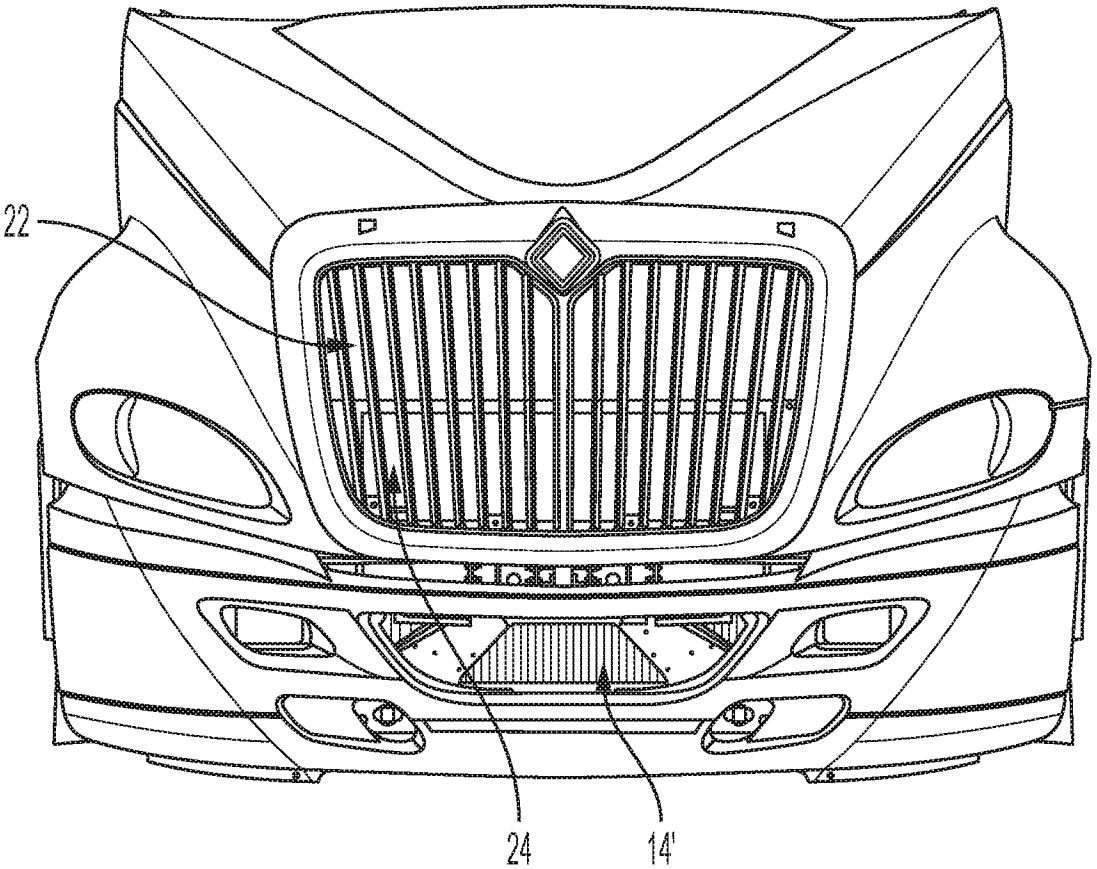
FIG. 7 is a fragmented front view of a vehicle with an integrated cooling system according to the present disclosure mounted in the engine compartment.

As best shown in FIGS. 5-7, recouperator 12' and coolant boiler 14' are disposed outside (above and below, respectively) the space receiving ram air 60 ("a ram air path"). As neither heat exchanger requires ram air 60, they are positioned so as not to obstruct ram air 60 to CAC 22, AC condenser 24 and radiator 26.

Figure 8:
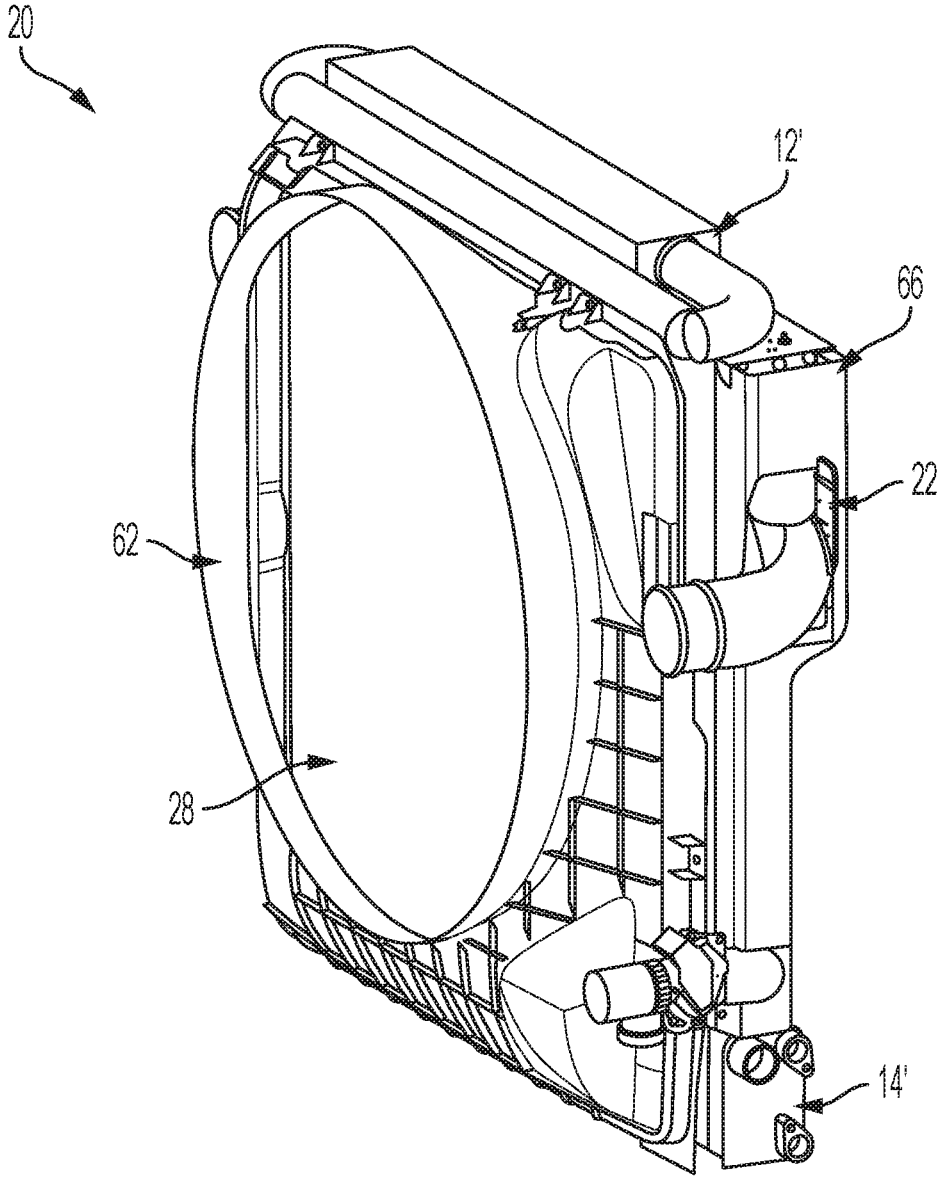
FIG. 8 is a perspective view of the integrated cooling system of FIG. 2.

FIG. 8 depicts system 20 with a fan shroud 62 attached over WHR condenser 28. FIG. 8 also shows the components of system 20 attached to and supported by frame 66.

Figure 9:
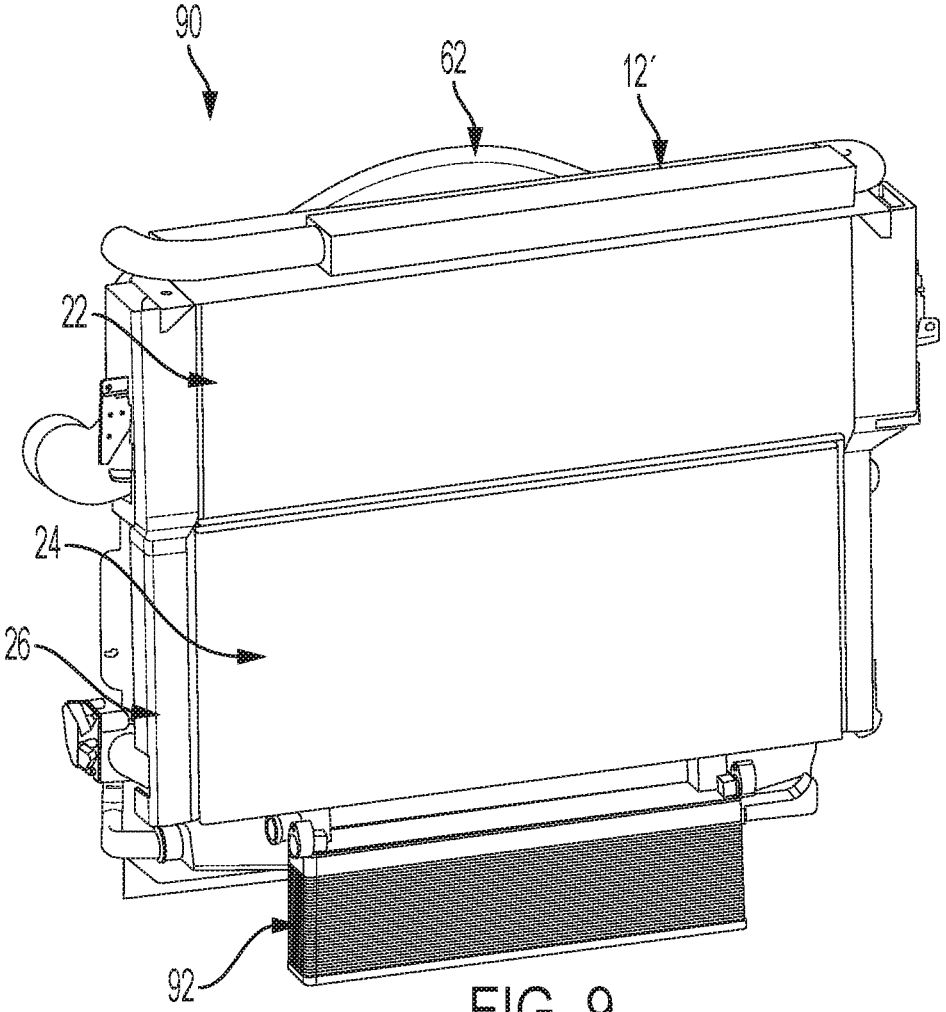
FIG. 9 is a perspective view of additional embodiments of an integrated cooling system of the present disclosure.

FIG. 9 shows another embodiment of an integrated cooling system according to the present disclosure. System 90 includes the same components as those discussed above with reference to system 20. Accordingly, the same reference designations are used for those components except for coolant boiler 92. As shown, coolant boiler 92 is substantially shorter side-to-side relative to coolant boiler 14'. Otherwise, the connections and operation of coolant boiler 92 are the same.

Figure 10:
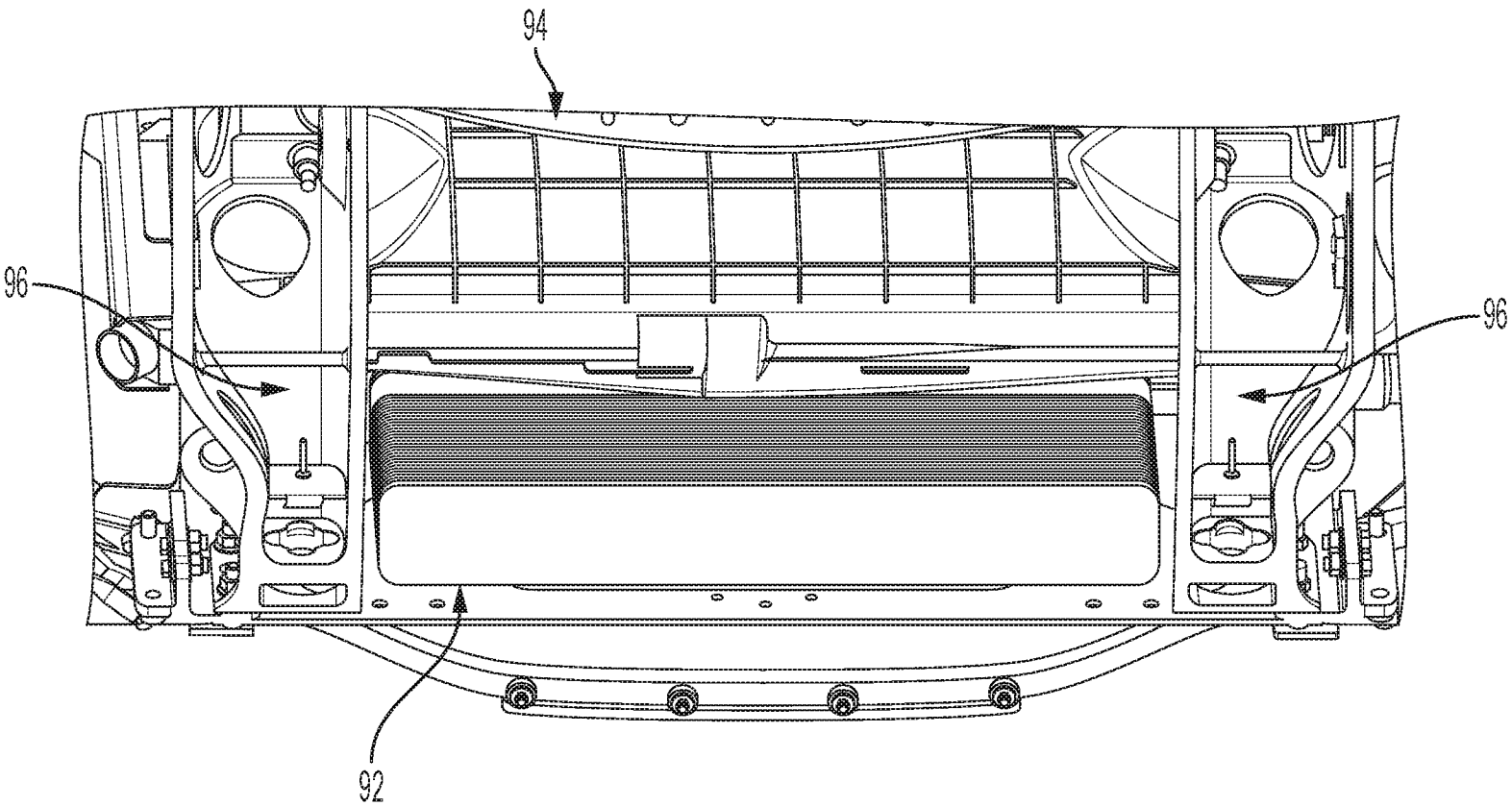
FIG. 10 is a bottom view of the integrated cooling system of FIG. 9 mounted to a vehicle chassis.

As shown in FIG. 10, which is a bottom view of a vehicle chassis with system 90 installed, the reduced size of coolant boiler 92 permits use of system 90 with a vehicle chassis 94 having chassis rails 96 that would otherwise prevent use of a wider coolant boiler such as boiler 14'.

As should be understood from the forgoing, the integrated compact cooling systems disclosed herein provide, among other things, "off-engine" heat exchangers and reduced plumbing for mass transfer between heat exchangers, thereby reducing the space claim of the WHR system on the engine. Moreover, various systems disclosed herein preserve the existing ram air path for the CAC and radiator by locating the non-ram cooled heat exchangers (i.e., the recouperator and coolant boiler) at the top and bottom of the system, respectively, outside the ram air path. Additionally, by moving the recouperator and coolant boiler off-engine, the systems reduce the complexity of incorporating a WHR system onto a base engine.

Various embodiments of the cooling system described herein for use in WHR systems may also provide numerous benefits including, for example: (1) integrating a receiver of a WHR system into a condenser of the WHR system in a single unit thereby reducing leak paths; (2) disposing a lift pump into the receiver to further reduce the leak paths, provide cost savings, and increased transient capability; (3) disposing a level sensor in the receiver to measure in real time the level of a working fluid in the receiver; (4) controlling the speed of the lift pump to control a flow rate of the working fluid in response to a level of the working fluid in the receiver or based on a feed pump inlet subcooling measured via pressure and temperature of the fluid supplied to the feed pump.

Figure 11:
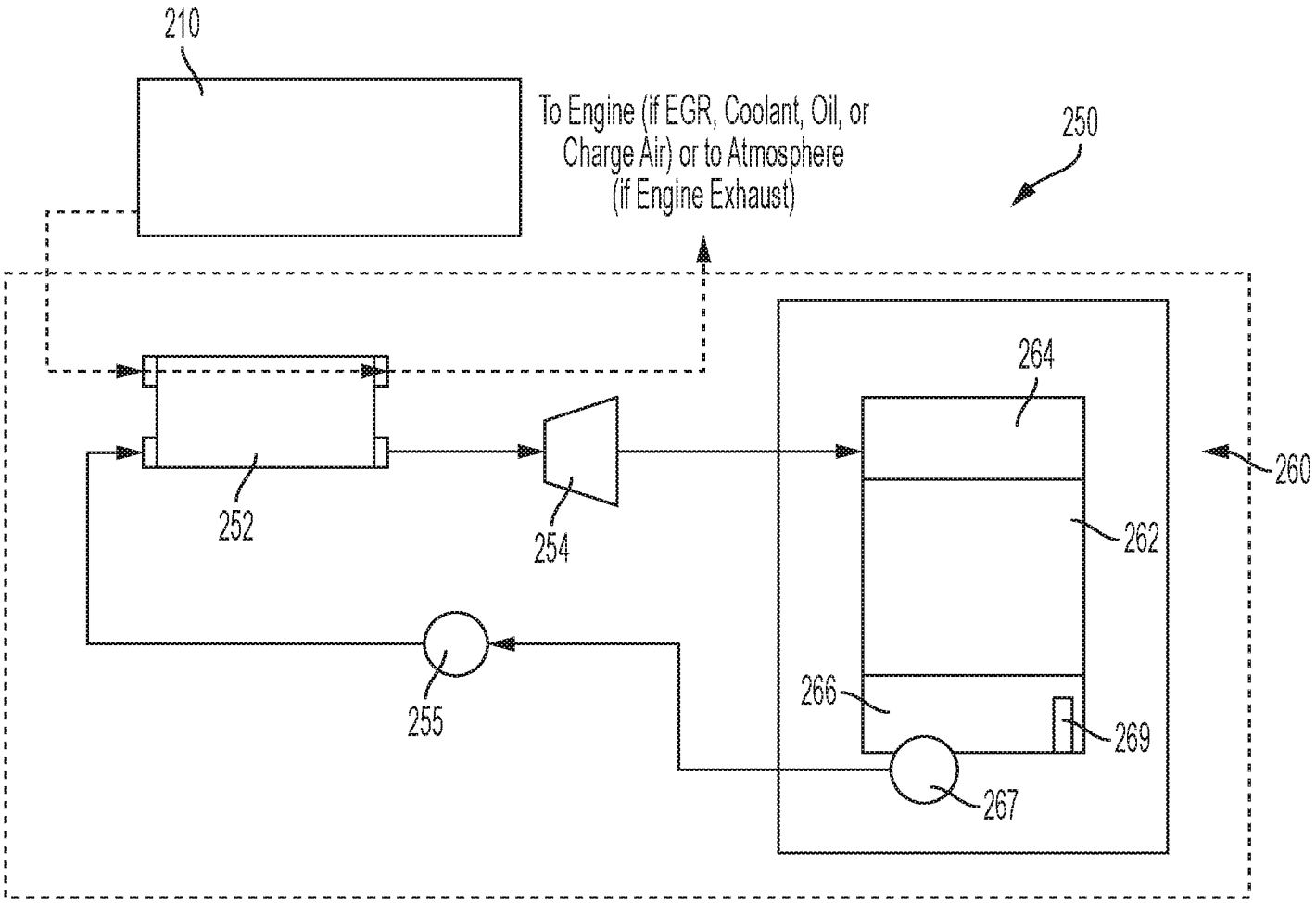
FIG. 11 is a schematic block diagram of a waste heat recovery system including a cooling system, according to an embodiment.

FIG. 11 shows a schematic block diagram of such a WHR system 250. The WHR system 250 includes a heat exchanger 252, an energy conversion device 254, a feed pump 255, and a cooling system 260.

The WHR system 250 is configured to extract heat from a waste heat source (e.g., an exhaust gas and/or a compressed intake gas and/or coolant and/or engine oil) and convert the heat into usable energy. The heat exchanger 252 is configured to receive a waste heat source or sources from an engine 210. The engine 210 can include an IC engine, for example, a diesel engine, a gasoline engine, a natural gas engine, a positive displacement engine, a rotary engine, or any other suitable engine, which converts a fossil fuel into mechanical energy. The combustion of the fossil fuel (e.g., diesel) in the engine 210 produces an exhaust gas at an elevated temperature (e.g., in the range of about 550 degrees Fahrenheit to about 1300 degrees Fahrenheit). Furthermore, the engine 210 can be configured to receive an intake gas heated to a substantially high temperature (e.g., a compressed intake gas heated to a temperature of about 550 degrees Fahrenheit to about 1300 degrees Fahrenheit).

The feed pump 255 is fluidly coupled to the heat exchanger 252 and configured to pump a working fluid through the heat exchanger 252. The working fluid can include any suitable working fluid which can extract heat from the high grade heat source and change phase, for example, vaporize. Various working fluids can include, for example, Genetron® R-245fa from Honeywell, low-GWP alternatives of existing refrigerant based working fluids, Therminol®, Dowtherm J™ from Dow Chemical Co., Fluorinol® from American Nickeloid, toluene, dodecane, isododecane, methylundecane, neopentane, neopentane, octane, water/methanol mixtures, ethanol steam, and other fluids suitable for the anticipated temperature ranges and for the materials used in the various described devices and systems.

The working fluid can extract the heat from the waste heat source and change phase, for example, vaporize within the heat exchanger 252. The waste heat source can be directed either back to the engine if it is coolant, oil, charge air, exhaust gas that is part of an exhaust gas recirculation (EGR) system, or exhaust gas that is communicated to an after-treatment system for removing particulates, $SO_x$ gases, $NO_x$ gases, or otherwise treating the exhaust gas before expelling the exhaust gas to the environment.

The vaporized working fluid is communicated to an energy conversion device 254 which is configured to perform additional work or transfer energy to another device or system. The energy conversion device 254 can include, for example, a turbine, piston, scroll, screw, or other type of expander devices that moves (e.g., rotates) as a result of expanding working fluid vapor to provide additional work. The additional work can be fed into the engine's driveline to supplement the engine's power either mechanically or electrically (e.g., by turning a generator), or it can be used to drive a generator and power electrical devices, parasitics or a storage battery (not shown). Alternatively, the energy conversion device 254 can be used to transfer energy from one system to another system (e.g., to transfer heat energy from waste heat recovery system 250 to a fluid for a heating system).

The working fluid is communicated from the energy conversion device 254 to the cooling system 260. The cooling system 260 includes a condenser 262 configured to condense the working fluid. For example, the condenser 262 can include a down flow heat exchanger such that the condensed working fluid can flow downwards under the influence of gravity into the receiver 266. In other embodiments, any other condenser that can extract heat from the working fluid and condense the working fluid (e.g., urge the working fluid to condense from a vapor or gas phase to a liquid phase) can be used. In some embodiments, the condenser 262 can also include a sub-cooler, or a sub-cooling portion. In such embodiments, the sub-cooler can be disposed downstream of the condenser 262 and upstream of the receiver 266.

An inlet header 264 is fixedly disposed on a first end of the condenser 262. The inlet header 264 is fluidically coupled to the heat exchanger 252 via the energy conversion device 254 and configured to receive the working fluid from the heat exchanger 252. The inlet header 264 can include a manifold, chamber, or compartment configured to receive the heated working fluid from the heat exchanger 252 and communicate the working fluid to the condenser 262.

A receiver 266 is fixedly disposed on a second end of the condenser 262 opposite the first end. The receiver 266 is configured to receive the working fluid from the condenser 262, and is integrated with the condenser 262 to serve as an outlet header for the condenser 262. The receiver 266 can, for example, be a manifold, chamber or compartment structured to collect the condensed working fluid and maintain a volume of the working fluid within an internal volume defined by the receiver 266.

A lift pump 267 is disposed in the receiver 266 and configured to communicate the working fluid to the feed pump 255. The lift pump 267 can include any suitable lift pump, for example, an electrically driven lift pump, or, a mechanically driven pump (e.g., a centrifugal type pump, a positive displacement pump, a gear pump, a piston type pump etc.). In some embodiments, the lift pump 267 can include an inducer to reduce a net positive suction head required, for example, to pump the working fluid to the feed pump 255. The lift pump 267 can be integrated with the receiver 266 such that the condenser 262, the inlet header 264, the receiver 266, and the lift pump 267 are integrated into a single unit. The lift pump 267 can be a fixed or variable speed pump. The lift pump 267 can be activated prior to starting the engine 210, for example, to prime the feed pump 255 and/or communicate working fluid to other components for cooling and/or lubrication. A pumping speed of the lift pump 267 can be varied to control the filling pressure of the feed pump 255 which can, for example, affect feed pump 255 flow rate.

In some embodiments, the lift pump 267 speed may be varied in response to lift pump 267 inlet pressure, lift pump 267 pressure rise, feed pump 255 inlet pressure, engine 210 speed, engine 210 load, ambient conditions, speed of a vehicle on which the engine 210 is mounted, working fluid temperature at lift pump 267, working fluid temperature at energy conversion device 254 inlet, feed pump 255 outlet pressure, and/or fault condition of the waste heat recovery system 200 or feed pump 255. Moreover, the lift pump 267 speed can be varied to control the level of the working fluid in the receiver 266.

A level sensor 269 is disposed in the receiver 266 and configured to measure a level of the working fluid in the receiver 266. The level sensor 269 can include a float sensor, a resistive level sensor, a capacitive level sensor, or any other suitable sensor that can measure a level of the working fluid disposed in the receiver 266 in real time. Measurement of the working fluid level in the receiver 266 by the level sensor 269 can, for example, be used to determine the flow rate of the working fluid through condenser 262, and/or an efficiency of the condenser 262. Based on this information, the speed of the lift pump 267 can be varied to control the level of the working fluid in the receiver 266.

In some embodiments, the condenser 262, the inlet header 264, the receiver 266, the lift pump 267 and the level sensor 269 can be integrated with each other in a single unit. In this manner, the cooling system 260 can be a single unit or otherwise which can be installed in a system, for example, a vehicle that includes the engine 210. This allows for easy installment or replacement of the cooling system 260.

Integration of the components into the single unit can reduce leak paths, increase performance, increase transient capability, and provide substantial cost savings (e.g., by reducing labor or materials cost during maintenance). The performance can be improved because the working fluid exiting the condenser 266 can be at or near saturation. Thus, the condenser 262 pressure can be lower for the cooling system 260 as the receiver 266 is disposed at the outlet of the condenser 262. Lower condenser 262 pressure results in greater energy conversion device 256 work in the working fluid cycle.

Disposing the lift pump 267 in the receiver 266 also allows more flexibility in placement of the feed pump 255 which performs the primary pressure rise of the working fluid within the waste heat recovery system 250. The lift pump 267 can supply the necessary pressure rise to provide sufficient suction pressure to the feed pump 255 to prevent cavitation.

Furthermore, the ability to control the lift pump 267 at variable speeds provides additional control and flexibility to the system 200, for example, feed pump 255 sub-cooling control and/or variable feed pump 255 flow rate by changing the sub-cooling at the inlet of the feed pump 255.

Figure 12:
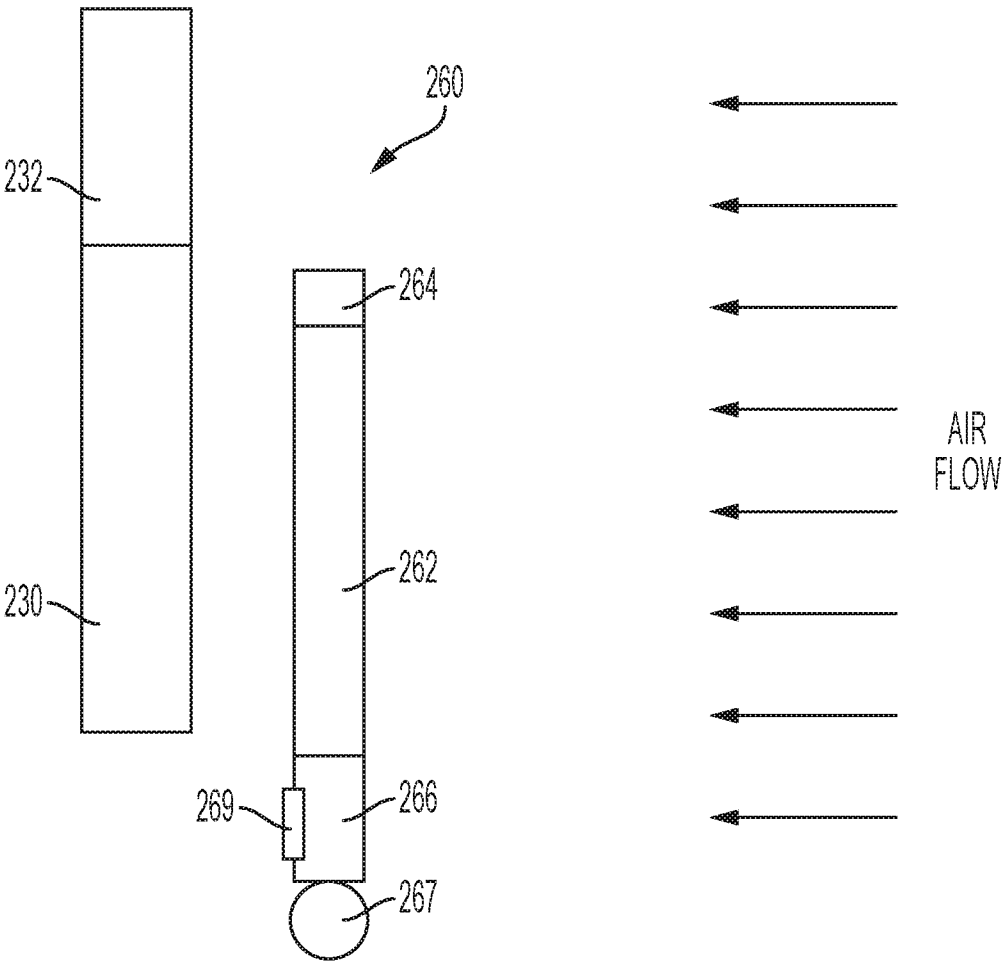
FIG. 12 is a side view of the cooling system of FIG. 11 showing an exemplary location of the cooling system in a system.

The cooling system 260 can be disposed in any suitable position in relation to other components, systems, or assemblies of a system that includes the WHR system 250. FIG. 12 shows a side view of the cooling system 260 disposed in front of a radiator 230 and charge air cooler 232 included in a cooling system of a system relative to a flow of air into the system. For example, the system can include a vehicle (e.g., a diesel passenger car or a diesel truck) and the cooling system 260 can be disposed in front of the radiator 230 and charge air cooler 232 relative to the direction of air flow. In other embodiments, the cooling system 260 can be disposed at any other location relative to the one or more heat exchangers included in the system (e.g., behind the radiator 230 and the charge air cooler 232, in front or behind an air conditioner condenser and/or a transmission cooler included in the system).

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more."

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A cooling system for a waste heat recovery ("WHR") system, comprising:

a frame configured for mounting to a vehicle chassis in a path of ram air entering an engine compartment of a vehicle;

a recouperator connected to the frame above the ram air path, the recouperator operable to heat a refrigerant with heat provided by a working fluid;

a radiator connected to the frame in the ram air path;

a WHR condenser connected to the frame and fluidly connected and positioned to drain the working fluid into the WHR condenser; and a coolant boiler connected to the frame in a stacked arrangement with the recouperator, wherein the coolant boiler is fluidly connected to receive the heated refrigerant from the recouperator.

2. The cooling system of claim 1, wherein the WHR condenser is connected to the frame downstream of the radiator relative to the ram air path.

3. The cooling system of claim 1, wherein the WHR condenser is connected to the frame upstream of the radiator relative to the ram air path.

4. The cooling system of claim 1, further comprising a charge air cooler connected to the frame.

5. The cooling system of claim 4, wherein the charge air cooler is in the ram air path.

6. The cooling system of claim 1, further comprising a lift pump configured to communicate the working fluid to a feed pump.

7. The cooling system of claim 1, further comprising a WHR receiver fixedly disposed on the condenser and configured to receive the working fluid from the condenser.

8. The cooling system of claim 7, further comprising a lift pump fixedly disposed in the receiver and configured to communicate the working fluid to a feed pump.

9. The cooling system of claim 8, wherein the lift pump includes an inducer configured to reduce a net positive suction head.

10. A cooling system configured for use in a waste heat recovery system, comprising:

a condenser configured to condense a working fluid;

an inlet header fixedly disposed on a first end of the condenser, the inlet header fluidly coupled to a heat exchanger to receive the working fluid from the heat exchanger;

a receiver fixedly disposed on a second end of the condenser opposite the first end, the receiver configured to receive the working fluid from the condenser; and a lift pump fixedly disposed in the receiver, the lift pump configured to communicate the working fluid to a feed pump.

11. The cooling system of claim 10, wherein the lift pump is one of an electrically driven pump and a mechanically driven pump.

12. The cooling system of claim 11, wherein the mechanically or electrically driven pump includes one of a centrifugal type pump, a positive displacement pump, a gear pump, and a piston type pump.

13. The cooling system of claim 10, wherein the lift pump includes an inducer configured to reduce net positive suction head required.

14. The cooling system of claim 10, further comprising a level sensor disposed in the receiver, the level sensor configured to measure a level of the working fluid in the receiver.

15. A cooling system configured for use in a waste heat recovery system ("WHR"), comprising:

a condenser configured to condense a working fluid;

an inlet header fixedly disposed on a first end of the condenser, the inlet header fluidly coupled to a heat exchanger to receive the working fluid from the heat exchanger;

a receiver fixedly disposed on a second end of the condenser opposite the first end, the receiver configured to receive the working fluid from the condenser; and a level sensor disposed in the receiver, the level sensor configured to measure a level of the working fluid in the receiver, wherein the condenser, the inlet header, the receiver, a lift pump, and the level sensor are integrated with each other in a single unit.

16. The cooling system of claim 15, wherein the lift pump includes an inducer configured to reduce a net positive suction head.

17. The cooling system of claim 15, further comprising:

a frame configured for mounting to a vehicle chassis in a path of ram air entering an engine compartment of a vehicle;

a recouperator connected to the frame above the ram air path, the recouperator heating a refrigerant with heat provided by a working fluid;

a coolant boiler connected to the frame in a stacked arrangement with the recouperator, wherein the coolant boiler is fluidly connected to receive the heated refrigerant from the recouperator; and a radiator connected to the frame in the ram air path, wherein the condenser is connected to the frame and fluidly connected and positioned to drain the working fluid into the condenser.

18. The cooling system of claim 17, wherein the condenser is connected to the frame downstream of the radiator relative to the ram air path.

19. The cooling system of claim 18, wherein the coolant boiler is connected to the frame below the ram air path and is coupled to the radiator and the recouperator.

* * * * *